US005172574A

United States Patent [19]

Perfetto

[11] Patent Number: 5,172,574

[45] Date of Patent: Dec. 22, 1992

[54] LOCKING SYSTEM INCLUDING A CUSTOMIZED PADLOCK GUARD

[76] Inventor: Ralph J. Perfetto, 1312 - 85th St., Brooklyn, N.Y. 11228-3312

[21] Appl. No.: 647,471

[22] Filed: Jan. 29, 1991

[51] Int. Cl.[5] ..... E05B 67/38

[52] U.S. Cl. ..... 70/56; 70/100; 292/281

[58] Field of Search ..... 70/54–56, 70/417, 95, 100; 292/281

[56] References Cited

U.S. PATENT DOCUMENTS

| | | | |
|---|---|---|---|
| 688,747 | 12/1901 | McMillen | 292/281 |
| 3,392,555 | 7/1968 | Beaver | 70/56 |
| 3,610,668 | 10/1971 | Tixier | 292/DIG. 41 X |
| 3,736,016 | 5/1973 | Garvey et al. | 70/56 X |
| 3,769,821 | 11/1973 | Randel | 70/33 |
| 3,884,057 | 5/1975 | Maurer | 70/259 |
| 3,996,774 | 12/1976 | Best | 70/54 X |
| 4,030,321 | 6/1977 | Kenyon | 70/54 X |
| 4,033,155 | 7/1977 | De Lucia | 70/56 |
| 4,033,156 | 7/1977 | Cottingham | 70/56 |
| 4,322,102 | 3/1982 | Lindblom | 292/281 |
| 4,380,160 | 4/1983 | Hoffman | 70/14 |
| 4,535,612 | 8/1985 | Seremet | 70/56 |
| 4,760,720 | 8/1988 | Grille | 70/54 |
| 4,835,996 | 6/1989 | Loughlin et al. | 70/53 |
| 4,843,845 | 7/1989 | Poe | 70/54 |
| 4,852,920 | 8/1989 | DeForrest, Sr. | 292/205 |
| 4,866,960 | 9/1989 | Brower | 70/56 |

*Primary Examiner*—Lloyd A. Gall
*Attorney, Agent, or Firm*—Norbert P. Holler

[57] ABSTRACT

A locking system utilizing a padlock guard which is designed specifically for use with a padlock of the type disclosed in U.S. Pat. No. 3,769,821. The lock has a flat-faced cylindrical housing and an internal key cylinder-operatable bolt which can be selectively protracted through and retracted from a hasp staple or the like inserted into a channel in the housing which intersects the path of movement of the bolt. The guard consists of a substantially cylindrical frontally open shell which has an inner diameter just slightly greater than the outer diameter of the lock housing and in one embodiment is welded to a hasp or the like in surrounding relation to the staple-accommodating slot therein. In another embodiment, the guard is welded to, and around the staple-accommodating slot in, the front side wall of a guide track rail for a sliding gate. In use, the lock is slid axially into and out of the guard, the latter being circumferentially interrupted to a limited extent at one part thereof corresponding to the location of and to provide access to the key cylinder of the padlock.

6 Claims, 4 Drawing Sheets

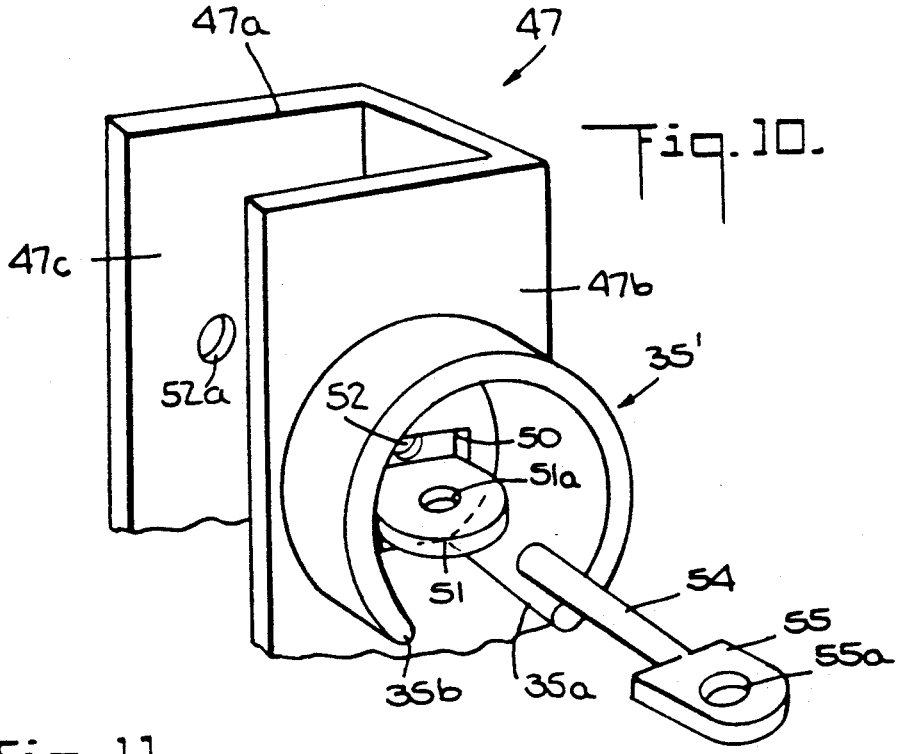
Fig. 10.
Fig. 11.
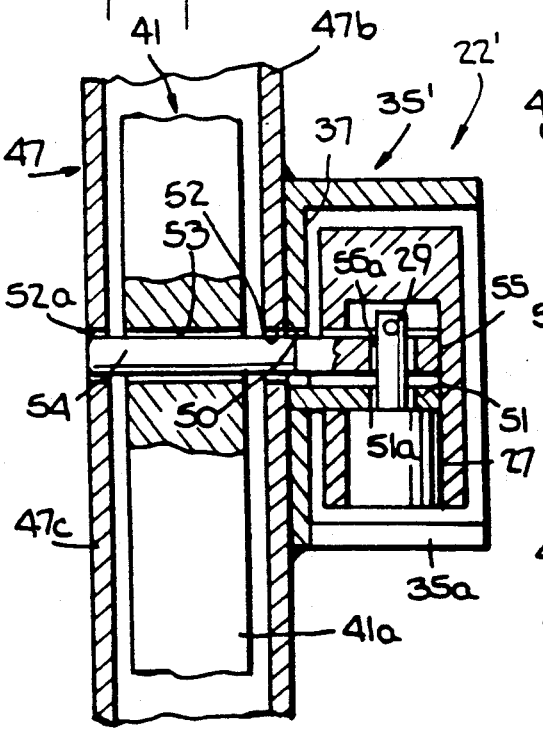
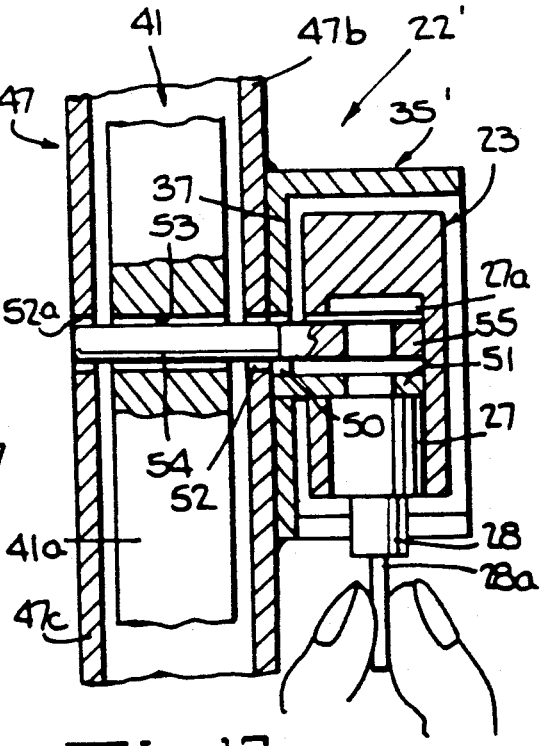
Fig. 12.

LOCKING SYSTEM INCLUDING A CUSTOMIZED PADLOCK GUARD

This invention relates to locking system, and in particular to a locking system which utilizes a mechanical padlock guard designed specifically for use with a lock of the type disclosed in U.S Pat. No. 3,769,821.

BACKGROUND OF THE INVENTION

Burglary, aimed at the theft of property from both commercial and private premises, whether these be movable road vehicles such as trucks, vans, recreational vehicles, trailers, and the like, or stationary structures such as stores, warehouses, garages, barns, and the like, is an ever growing problem in our society. Even the development of sophisticated anti-theft devices such as burglar alarms (with or without a direct link to a police station or a private protective company central office) and special pickproof locks, as well as the development of high-quality conventional padlocks and hasps, has not stemmed the tide, because the sophistication of the burglars has advanced commensurately. Frequently, it takes a professional thief less than a minute to overcome any of the currently available anti-theft devices, even if that requires sawing or cutting through the shackle or bolt of a padlock or the staple of a hasp. By and large, of course, speed and silence in neutralizing an anti-theft device and entering the protected premises are the principal desiderata for a burglar, because they lessen the chances of his or her being detected and apprehended.

Numerous attempts have been made over the years to provide guards for conventional padlocks. Representative of the more recent of these are the guards shown in U.S. Pat. Nos. 3,392,555 (Beaver 1968); 3,884,057 (Maurer 1975); 4,033,155 (De Lucia 1977); 4,322,102 (Lindblom 1982); 4,380,160 (Hoffman 1983); 4,535,612 (Seremet 1985); 4,843,845 (Poe 1989); 4,852,920 (DeForrest, Sr. 1989); and 4,866,960 (Brower 1989). The principal aim of these and other lock guard devices has been to make it more difficult and hence time-consuming for a burglar to gain access to the lock for the purpose of cutting either the bolt or shackle of the lock or the staple of an associated hasp with a bolt cutter or for sawing through such a shackle or staple with a hacksaw. Nevertheless, to the best of my knowledge the known lock guards have not become universally accepted; quite to the contrary, an inspection of any random number of padlocked store fronts and truck or van doors reveals that in almost all so-protected premises a standard padlock is used without an associated guard structure, the only feature being relied on for increasing the difficulty of destruction of the lock by means of a hacksaw or a bolt cutters being the increase in the size of the lock and in particular in the thickness of the bolt or shackle of the padlock and/or of the staple of the hasp.

One particular non-conventional type of padlock which was originally invented for use in protecting the cabinets of coin-operated vending machines is the cylindrical lock disclosed in U.S. Pat. No. 3,769,821 (Randel 1973). This type of lock has a flat-faced cylindrical housing which is partially traversed substantially axially thereof by a slot-shaped channel extending inwardly from one of the flat faces of the housing, the channel being adapted to receive a pair of apertured flanges supported by co-operating parts of the closure of the cabinet and arranged to have their respective apertures in registry with one another when the cabinet is closed. Internally, the housing of the lock is further partially traversed by a diametrical passageway which extends from the circular wall of the housing and perpendicularly intersects the channel. Slidably disposed for both rotary and axial movement in the passageway is a key cylinder which at its innermost end carries a straight rod or bolt. The arrangement is such that the bolt is protracted across the channel when the key cylinder is pushed into the housing and into its locked position, and that the bolt is retracted from the channel when the cylinder is released by the key and shifted outwardly of the housing to its unlocked position. When the cabinet is closed, the two flanges are in back to back abutting relation with each other and have a combined thickness just a little less than the height of the channel in the lock housing. As a consequence, the lock can be slid axially onto the flanges by fitting the channel over them until the lock is fully seated thereon. Since at that point the registered apertures of the two flanges are aligned with the bolt, the latter can be axially protracted through the apertures in the flanges and locked in place by the key cylinder, thereby to secure the lock to the flanges.

The principal difference between the Randel lock and the conventional padlocks was, of course, the fact that it did not have the usual U-shaped link or shackle, i.e., that it had no exposed element which could be rapidly and relatively easily cut through by a bolt cutter or sawed through by a hacksaw. This was certainly an advantage of sufficient magnitude that, one would think, ought to have more than justified the somewhat higher cost of the Randel lock. Nevertheless, the commercial preeminence of conventional padlocks in the marketplace has remained substantially unimpaired, quite possibly (although the reason may be somewhat more complicated) because the Randel lock is actually not invulnerable to a skilled and determined burglar in at least one respect by virtue of the construction of the lock and the flanges. Thus, when the lock, in use, is mounted on and secured to the flanges of the closure components of a cabinet or comparable protected structure, the back flat face of the lock housing is invariably spaced somewhat from the thereto juxtaposed faces of the respective base members of the two flanges by which the latter are secured to the cabinet or other structure being protected. This enables either the prying end of a crowbar or the blade of a hacksaw to be inserted into the space behind the lock for either breaking the lock off the flanges by brute force or sawing through the flanges on which the lock sits.

BRIEF DESCRIPTION OF THE INVENTION

It is an object of the present invention, therefore, to provide a novel and improved locking system which includes a padlock guard that is specifically designed for use with the Randel lock, i.e., a lock of the type disclosed in U.S. Pat. No. 3,769,821.

It is another object of the present invention to provide such a locking system the padlock guard and other components of which are so constructed as to render an easy, i.e., simple, quiet and speedy, destruction of any part of the lock or its mounting in use effectively impossible, and which, in contrast, will require so much effort, time and noise by a burglar to destroy the lock and its mounting as to materially increase the burglar's risk of detection and apprehension.

Generally speaking, the objectives of the present invention are attained by a locking system including a padlock guard which has the shape of a substantially cylindrical shell the wall thickness of which is at least about 3/16 inch (about 0.5 cm). The guard is made of a sheet or strip of a high strength metal, such as carbon steel or a comparable metal or metal alloy having a sufficient hardness to be highly resistant to sawing, hammer blows, and the like, and has an inside diameter of about 3⅛ inches (about 7.9 cm), i.e., slightly greater than the outside diameter (3 inches) of the Randel lock so as to accommodate the housing of the lock freely but with a nearly sliding fit, and an axial dimension or depth of about 2 inches (about 5.1 cm), i.e., somewhat greater than the axial thickness (1½ inches) of the lock so that in use no part of the lock protrudes beyond the front edge of the guard.

In one embodiment of the present invention, for example, where the Randel lock is to be used with a hasp for sealing the doors of a protected vehicle such as a truck or van, the guard is axially open at both its front and rear edges and is welded at its rear edge to the front face of the hinged slotted plate of the hasp in essentially symmetrically surrounding relationship to the staple-accommodating slot thereof.

In another embodiment of the present invention, for example, where the Randel lock is to be used with a track-guided sliding gate for sealing a protected structure such as a storefront or a warehouse entrance, the guard includes a backplate which fully overlies the rear opening of the shell, the shell thereby having a generally cup-shaped configuration. The backplate is provided with a substantially symmetrically located slot therein which is sufficiently wide to accommodate two mutually superposed and aligned cooperating staples, one of which is the fixed staple that is welded to and projects from the front or outside flange of a respective guide track rail for the sliding gate directly adjacent a round opening conventionally provided in that flange, and the other of which is the cooperating removable staple which has a bar- or rod-shaped leg or extension adapted to be received in the round opening in the front rail flange as well as in a corresponding opening provided in the rear or inside flange of the guide track rail. In this embodiment, the guard is welded at its rear edge to the front flange of the guide track rail for the gate so as to locate a part of the slot in the backplate in alignment with the openings in the front and rear flanges of the guide track rail, so that the leg of the removable staple may be inserted across the track from the front through the slot in the backplate of the guard and the openings in the front and rear flanges of the rail.

By virtue of this type of construction, the padlock as well as either the staple of the hasp or the combination staple structure of the guide track rail are rendered effectively immune to rapid and silent attack and destruction by hacksaws, bolt cutters, hammers and the like. A so-protected vehicle or building structure will thus be of relatively limited interest to a prospective burglar or thief because of the higher degree of difficulty he or she will face to gain entrance to the protected premises in the shortest possible time and with the least amount of noise.

BRIEF DESCRIPTION OF THE DRAWINGS

The foregoing and other objects, characteristics and advantages of the present invention will be more clearly understood from the following detailed description thereof when read in conjunction with the accompanying drawings, in which:

FIG. 10 is a fragmentary exploded perspective view of a section of one of the guide track rails for the sliding gate shown in FIGS. 8 and 9 and illustrates the padlock guard and a fixed and a removable staple constituting parts of the locking system;

FIG. 11 is a sectional view taken along the line 11—11 in FIG. 8 and illustrates the Randel padlock with its key cylinder in the locked condition and its internal bolt protracted into the aligned apertures of the fixed and removable staples; and FIG. 12 is a sectional view similar to FIG. 11 and illustrates the Randel padlock with its key cylinder in the unlocked condition and its internal staple-engaging bolt retracted.

DETAILED DESCRIPTION OF THE INVENTION

Figure 2:
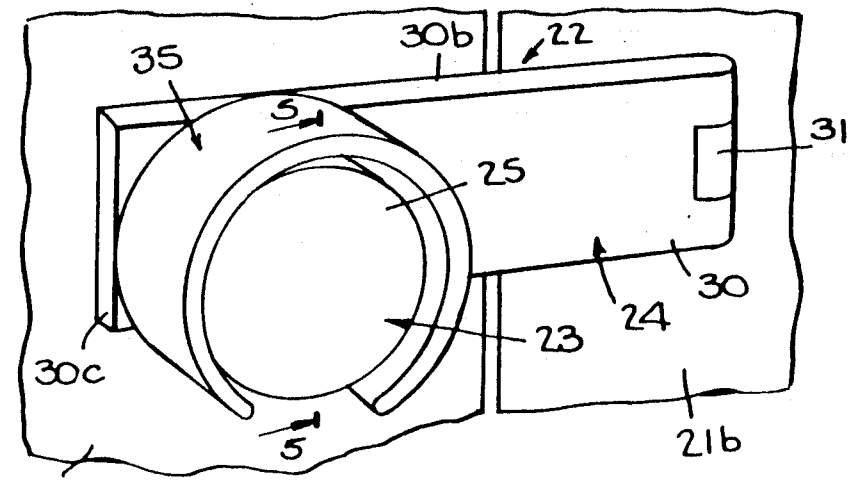
FIG. 2 is a perspective view of the locking system shown in the circled area of FIG. 1, but is drawn to a larger scale and shows a protective flange on the hinged plate of the hasp.
Figure 3:
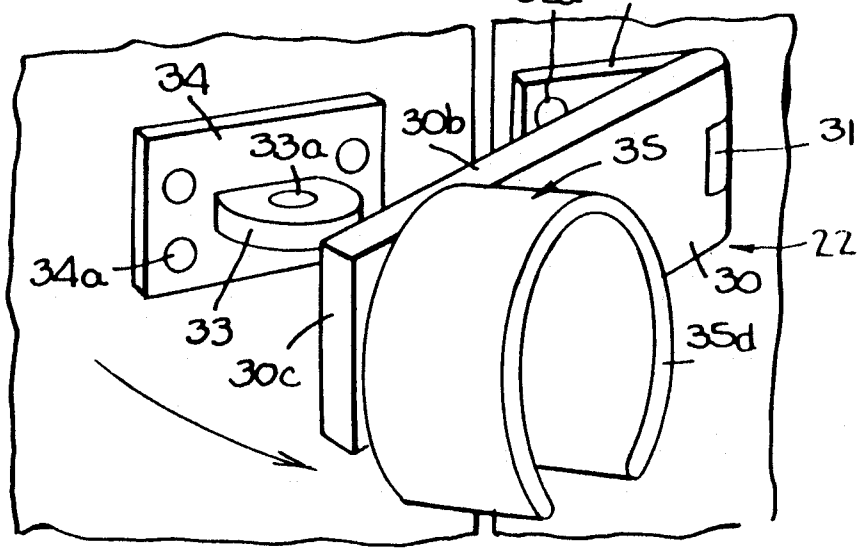
FIG. 3 is a perspective view of the locking system shown in FIG. 2 but without the padlock and with the hasp in its open state.
Figure 1:
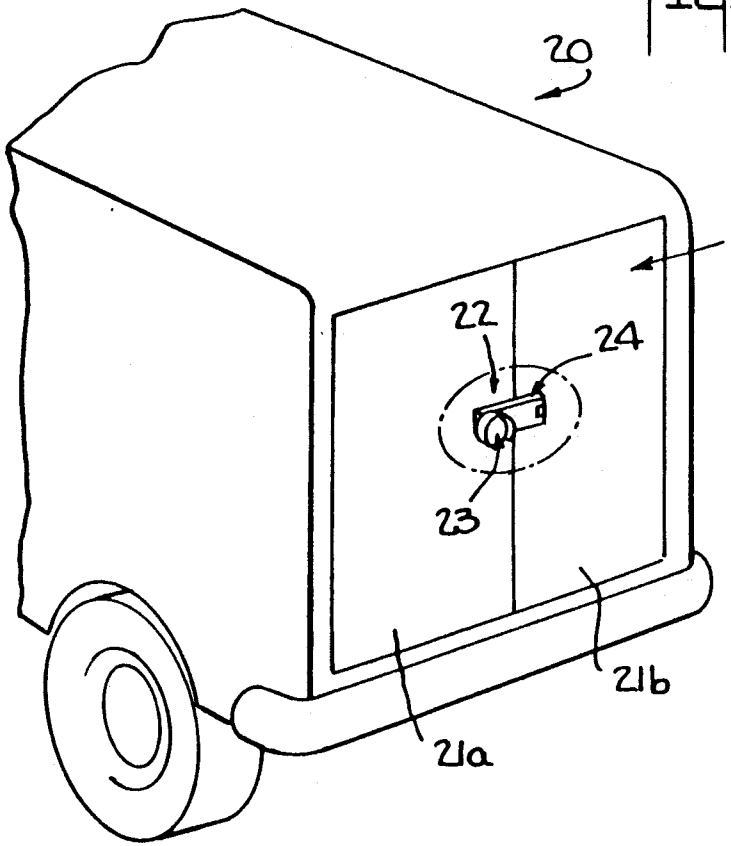
FIG. 1 is a perspective view of the rear end of a truck, van or like vehicle the rear doors of which in their closed state are locked by means of a locking system according to the present invention and including a hasp, a Randel padlock, and a customized lock guard therefor.

Referring now to the drawings in greater detail, FIG. 1 shows the rear end of a truck or van 20 such as may be used by a tradesman or a delivery man, for example, and which includes at its rear end a closure arrangement 21 consisting of a pair of hinged, outwardly swingable doors 21*a* and 21*b*. The vehicle may, of course, be other than of a commercial nature; for example, it may be a recreational vehicle or may be suited for use by a private individual for personal travel. Also, the closure arrangement may be located on the side of the vehicle rather than at the back, and in either case it may utilize only one door which either may be swingably hinged about an either horizontal or vertical axis or may be laterally translatable or vertically slidable. Such a vehicle may, therefore, be used to transport tools, equipment and working materials, merchandise, camping gear, luggage and other personal property, etc., all of which are fair bait for a burglar or thief on the prowl for some easy money.

Conventionally, the closure arrangement of such a vehicle is equipped with a key-operated lock built either right into the door or into a handle structure supported by the door. Alternatively, of course, the door may be locked by a padlock the U-shaped shackle or bolt of which is passed through the staple of a hasp or the apertures of a pair of flanges or like structural members projecting from respective elements of the closure arrangement, e.g., the two doors 21*a* and 21*b* or, in the case of a single door, the door and an adjacent part of the vehicle body, and arranged to be closely juxtaposed to and aligned with each other when the vehicle door is shut. Neither of these types of locking means, nor even the type of padlock disclosed in U.S. Pat. No. 3,769,821, serves as much of a deterrent to a determined thief or burglar, however, for the reasons already set forth hereinabove.

Figure 5:
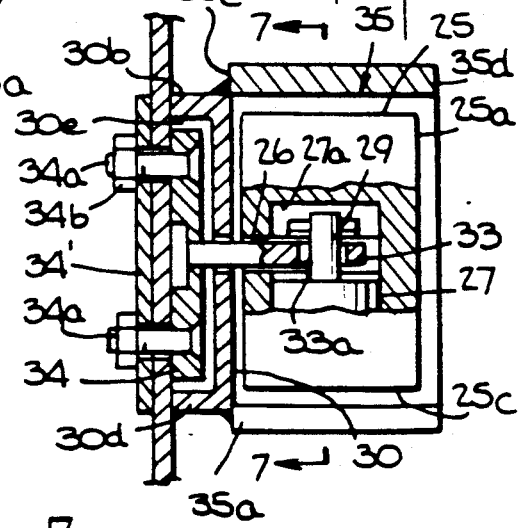
FIG. 5 is a sectional view taken along the line 5—5 in FIG. 2 and illustrates the Randel padlock mounted on the staple of the hasp internally of the lock guard and with its internal bolt protracted through the aperture in the staple of the hasp and its key cylinder in the locked state.
Figure 6:
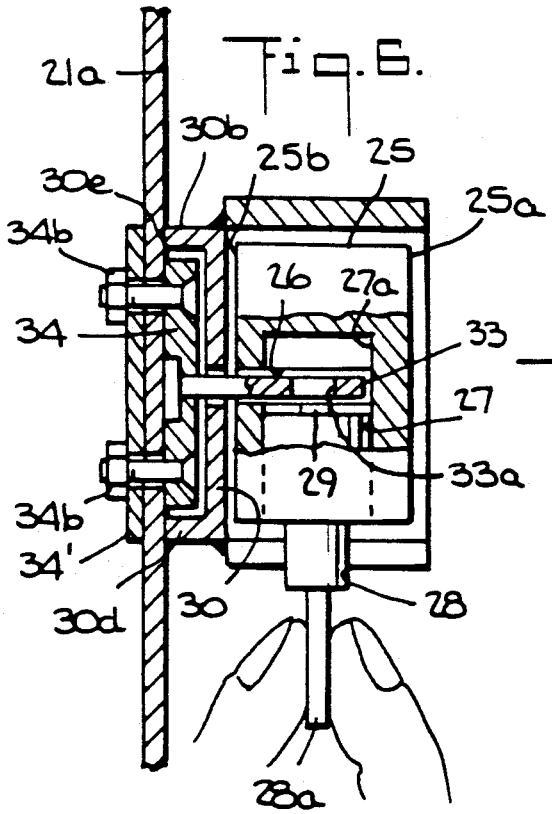
FIG. 6 is a sectional view similar to FIG. 5 but illustrates the padlock with its internal bolt retracted from the staple by the opening of the key cylinder of the lock.
Figure 7:
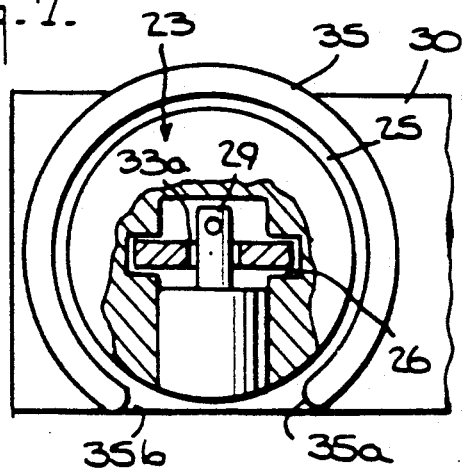
FIG. 7 is a sectional view taken along the line 7—7 in FIG. 5.

In accordance with one embodiment of the present invention, therefore, this drawback is overcome by the provision of a locking system 22 which includes a padlock 23 of the type disclosed in U.S. Pat. No. 3,769,821 and a correspondingly specially constructed hasp 24. The padlock 23 includes, as best shown in FIGS. 2, 5, 6 and 7, a cylindrical body or housing 25 preferably made of steel or a comparable metal or metal alloy. The housing has substantially flat opposite front and back faces 25*a* and 25*b*, an axial channel 26 of generally rectangular transverse cross-section extending inwardly of the housing from the back face 25*b* toward but terminating short of the front face 25*a*, and a diametrical passageway 27-27*a* extending inwardly from one part of circumferential face 25*c* of the housing 25 and intersecting the channel 26 substantially centrally of the housing 25. Slidably arranged within the passageway section 27 for both axial and rotational movement is a key cylinder 28 which at its outwardly directed end has an opening (not shown) to receive a key 28*a* and which at its inward end carries a rod or bolt 29. The bolt 29 can be protracted by the key cylinder 28 across the channel 26 and into the passageway section 27*a*, as shown in FIGS. 5 and 7, or can be retracted by the key cylinder from the passageway section 27*a* so as to clear the channel 26, as shown in FIG. 6.

Figure 4:
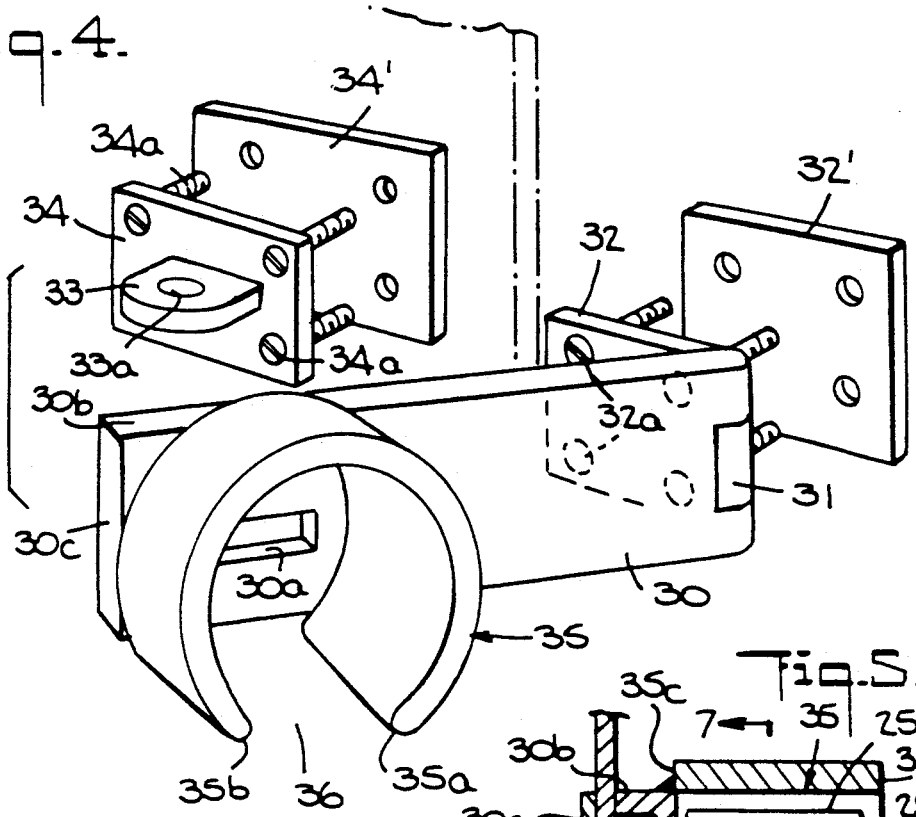
FIG. 4 is an exploded perspective view of the hasp shown in FIG. 3 and also illustrates a preferred manner of affixing the staple and the hinged plate of the hasp to the respective door panels of the vehicle.

For use with the lock 23, the hasp 24 (see also FIG. 4) includes, as usual, a hinged slotted plate 30 connected at one end by means of a hinge 31 to a base plate 32 adapted to be affixed to one component of the closure arrangement 21, e.g., the door 21*b*, and an apertured staple 33 extending perpendicularly from a base plate 34 adapted to be affixed to another component of the closure arrangement, e.g., the door 21*a*. The slot 30*a* in the hinged hasp plate 30 is dimensioned to accommodate the staple 33, and the aperture 33*a* in the latter is dimensioned to accommodate the bolt 29 of the padlock 23 and is located so as to be positioned in front of the hinged hasp plate when the staple projects through the slot 30*a* thereof. In the illustrated embodiment, the base plate 32 is secured to the door 21*b* by means of four ¼ inch threaded steel bolts 32*a* and associated lock washers and nuts (not shown), the threaded end sections of the shanks of the bolts being passed through a set of holes (not shown) provided therefor in the door and through a set of corresponding holes provided in a 3 inch by 3 inch by ⅛ inch steel backing or flitch plate 32′ positioned on the interior face of the door. The base plate 34 is correspondingly secured to the door 21*a* by means of bolts 34*a* and associated lock washers (not shown) and nuts 34*b* (see FIGS. 5 and 6) and with the aid of a backing or flitch plate 34, identical to the plate 32′.

For the purpose of providing the locking system 22 with the desired degree of anti-burglar protection, however, in accordance with the present invention the construction of the hasp 24 is modified somewhat from that of a conventional hasp. One of the novel features is that a guard 35, in the form of a substantially cylindrical shell which has a relatively small gap 36 defined in its circumference between a pair of opposed parallel axial edges 35*a* and 35*b* of the shell, is welded at its rear edge 35*c* to the front face of the plate 30 in symmetrically surrounding relation to the slot 30*a*. The guard is made of a metal or metal alloy sheet or strip preferably not less than about 3/16 inch (about 0.5 cm) thick and has an inner diameter slightly greater than the outer diameter of the lock housing 25, so as to accommodate the lock freely but with a nearly sliding fit, and an axial depth of about 2 inches (about 5.1 cm), so as to accommodate the full thickness (1½ inches) of the lock and leave no part of the lock housing protruding beyond the front edge 35*d* of the guard when the lock is fully inserted into the same. The gap 36 is preferably only wide enough to accommodate the key cylinder 28 and the key 28*a* when the lock 23 is to be inserted into or extracted from the guard 35 and thus may be as narrow as about ½ inch (about 1.25 cm), effectively precluding access to the back of the lock once it has been inserted into the guard and locked in place.

In order to further protect the vehicle against forced entry, the present invention provides another novel feature, namely, that the hinged hasp plate 30 is configured to prevent access to the space behind the plate 30. To this end, the hasp plate is rearwardly recessed by being provided with a peripheral flange 30*b*-30*c*-30*d* extending along the entire boundary of the plate 30 from the hinged end of the plate at one side thereof and back to the hinged end at the other side. As a practical matter, the flange is formed by a pair of longitudinally extending lateral edge portions 30*b* and 30*d* of the hasp plate which are bent perpendicularly rearwardly thereof, and by a transversely extending end edge portion 30*c* of the hasp plate also bent perpendicularly rearwardly thereof and welded at its opposite narrow ends to the adjacent narrow ends of the lateral edge portions 30*b* and 30*d*. The common width of the so-formed flange is at least equal to and actually is just somewhat greater than the thickness of the two base plates 32 and 34, and the width of the hasp plate 30 and hence the spacing of the flange portions 30*b* and 30*d* from each other is just greater than the width of the base plates 32 and 34, so that when the hasp plate is closed over the staple 33 and overlies the base plates, the latter are accommodated in the hasp plate recess 30*e* (FIGS. 5 and 6) bounded by the flange 30*b*-30*c*-30*d* and are fully covered by the hasp plate on all sides.

It will be understood, therefore, that in use when the vehicle is to be locked, for example, when the owner is planning to leave it parked and unattended, the hasp plate 30 is first closed over the staple 33 until the latter projects fully through the slot 30*a*. The Randel lock 23 is then fitted into the guard 35 so that the staple is received in the channel 26 of the lock, whereupon the key cylinder is manipulated as needed, e.g., as described in U.S. Pat. No. 3,769,821, to protract the bolt 29 of the lock through the aperture 33*a* of the staple and to lock it against retraction therefrom. The presence of the guard 35 and the flanged hasp plate 30 thus ensures that neither a hacksaw blade nor a bolt cutter can be easily inserted between the lock and the hasp plate or between the hasp plate and the vehicle doors for the purpose of sawing or cutting through the staple. At the same time, the bolt of the Randel lock cannot be sawed through or cut either, since it is inaccessibly located within the lock. Moreover, the strength of the guard in conjunction with that of the lock itself, that of the hasp plate and its flange, and that of the hasp mounting system (i.e., the base plates 32 and 34, the associated backing plates 32' and 34', and their fasteners) ensures that the locking system cannot be easily disabled with the aid of a hammer or a like tool, and the presence of the flange on the hasp plate and of the weld joint between the hasp plate and the guard ensures that the same result cannot be easily achieved with the aid of a crowbar.

Thus, by making it exceedingly difficult for a burglar or thief to overcome the hasp-type locking system of the present invention in a minimum of time and with a minimum of noise, the system will effectively inhibit burglaries of vehicles and other premises the doors of which are locked by such a hasp-type locking system. That is not to say, of course, that the locking system of the present invention will be able to withstand a violent attack using, for example, a sledgehammer or explosives, but that type of attack will not be favored by, and is unlikely to be used by, an ordinary burglar or thief to whom any action that takes more than a minimum of time or generates more than a minimum of noise is anathema.

Referring now to FIGS. 8–12, these illustrate the use of a locking system 22' according to the present invention in connection with a commercial structure such as a store 40 (the structure may, of course, be a garage, a warehouse, a barn, or even an office building). In the particular illustrated embodiment, the store 40 is shown as being provided at its front with a slidable steel gate 41 of conventional hinged or linked sectional construction adapted to overlie glass windows 42 and 43 and a glass door 44. A similar gate may, of course, be provided for each exposed part of the store, e.g., the side window 45. The gate 41 has its opposite side edge regions slidably received in the channels 46*a* and 47*a* of a pair of cross-sectionally U-shaped guide track rails 46 and 47 the parts of which outside the store extend vertically along the front surfaces of the store walls 48 and 49.

As is best shown in FIG. 10 for the rail 47, each of the rails 46 and 47 has a respective guard 35' (corresponding to the guard 35 shown in FIGS. 1–7) welded to its front side wall or flange 46*b* or 47*b*. The guard 35' differs from the guard 35, however, in that it includes a backplate 37 which overlies the entire rear opening of the shell. The backplate 37 is illustrated in FIGS. 11 and 12 as being a unitary part of the generally cup-shaped guard 35', with the latter being formed, for example, by means of a deep drawing or forging operation or the like, but alternatively the backplate and shell may be formed as separate elements and then welded to one another in the region of the rear edge of the shell. The backplate is provided with a substantially centrally located slot-shaped opening 50 the width of which (the height as seen in FIGS. 10–12) is sufficient to accommodate both a fixed staple 51, which is a standard element in many sliding gate locking systems using conventional padlocks and is welded to and projects frontwardly from the front flange 47*b* of the guide track rail 47 at a location closely adjacent to a usually round opening 52 conventionally provided in the rail flange 47*b*, and a likewise standard removable staple 55 when the same are in mutually superposed relation to each other. A part of the slot 50 thus is aligned with the opening 52, which enables a rod- or bar-shaped leg or extension 54 of the removable staple 55 to be fitted across the guide track rail by being inserted through the slot 50 and the opening 52 into a corresponding opening 52*a* provided in the rear or inside flange 47*a* of the guide track rail.

It will be understood, of course, that the openings 52 and 52*a* may be otherwise shaped than round in order to match a non-round cross-sectional shape of the staple leg or extension 54. It will further be understood that the horizontal section 41*a* of the gate 41 which, when the gate is lowered to its closed position, is located behind the guards 35', is provided in its opposite end regions with respective horizontal through passages or openings 53 (FIGS. 11 and 12). The arrangement thus is such that in the said lowered position of the gate, each of the passages or openings 53 is horizontally aligned with its respective set of front and rear openings 50, 52 and 52*a*.

Figure 8:
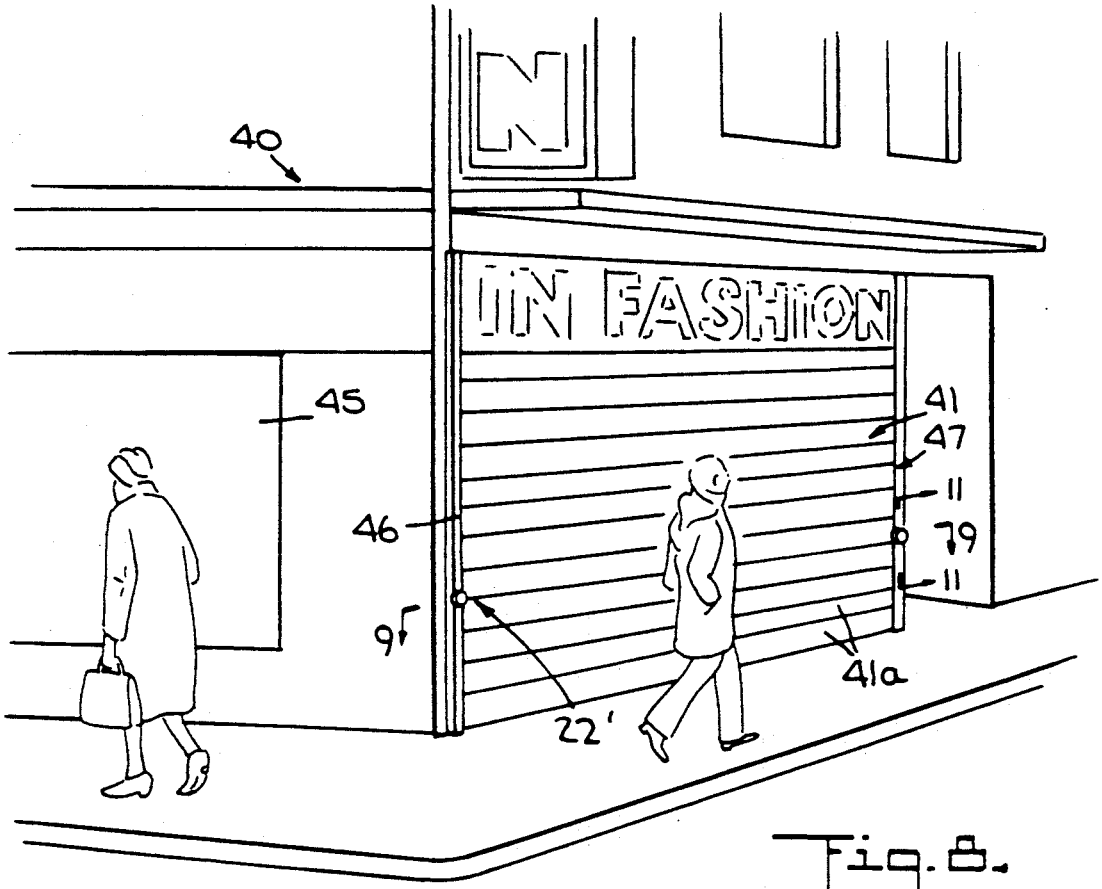
FIG. 8 is a perspective view of a locking system according to the present invention as used in connection with a store-front protected by a sliding metal gate having its opposite side edge regions confined in and running along a pair of opposed cross-sectionally U-shaped metal guide track rails.
Figure 9:
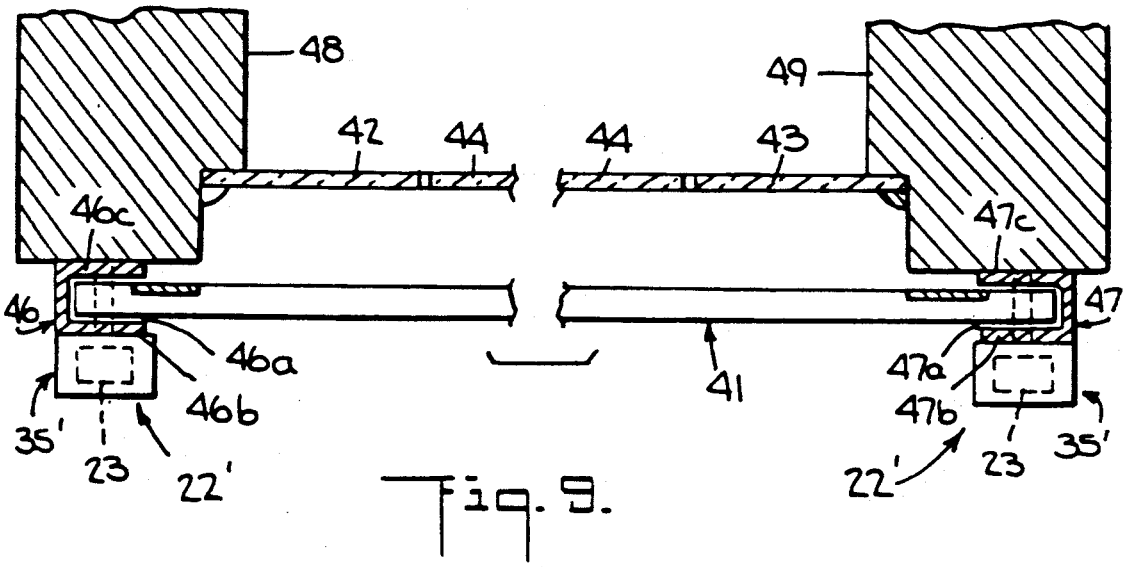
FIG. 9 is a fragmentary sectional view taken along the line 9—9 in FIG. 8 but drawn to a larger scale.

When the gate is in that position, therefore, a leg or extension 54 of a respective removable staple 55 can be inserted into the associated set of aligned openings 50-53-52-52*a* until the aperture 55*a* of that staple 55 is in registry with the aperture 51*a* of the underlying fixed staple 51. Preferably, for purposes of enhanced stability, when the removable staple 55 is so inserted in place, the rearwardmost region thereof where it adjoins the leg or extension 54, is received in the respective slot 50. Thereupon, the lock 23 (or each such lock if two are used, as indicated in FIGS. 8 and 9) is inserted into the associated guard 35' until the two superposed staples 51 and 55 are fully received in the axial channel 26 of the lock with their apertures 51*a* and 55*a* aligned with the diametrical passageway 27-27*a*. During the insertion, of course, the protruding key cylinder 28 is accommodated in the gap 36 defined between the edges 35*a* and 35*b* of the guard (FIG. 12). Once the lock is fully seated on the staples 51 and 55, appropriate operation of the key cylinder by the key 28*a* advances the cylinder into the lock housing, protracts the bolt 29 through the staple apertures 51*a* and 55*a* into the section 27*a* of the diametrical passageway 27-27*a*, and lastly looks the bolt into position (FIG. 11), as described in U.S. Pat. No. 3,769,821.

In this embodiment as in the one illustrated in FIGS. 1–7, therefore, not only is the bolt of the padlock inaccessible, but the welded-on guard precludes any access to the space between the back face of the lock housing and the front flange of the guide track rail, so that the staples cannot be reached and either cut or sawed through by a bolt cutter or a hacksaw. The guard itself is, of course, highly resistant to destruction by sawing or hammer blows and also highly obstructive to the use of a crowbar. As a consequence, a burglar or thief will find the locking system 22' so difficult and time-consuming to overcome without noise as to discourage him or her from even attempting a break-in into the protected premises.

Generally speaking, therefore, the present invention provides a burglar-resistant locking system for closure means, such as hinged doors, track-guided slidable gates, and the like, of protected premises such as vehicles, buildings and the like, which locking system utilizes apertured staple means associated with the closure means and a padlock of the type disclosed in U.S. Pat. No. 3,769,821 for cooperating with the staple means. The padlock includes a substantially cylindrical housing with flat front and back faces and a circular peripheral face, an axial channel extending inwardly from the back face of the housing toward the front face thereof but terminating short of the latter and being dimensioned to accommodate the staple means, a diametrical passageway extending inwardly from one part of the peripheral face of the housing toward but terminating short of the diametrically opposite part of the peripheral face and intersecting the axial channel substantially medially of the housing, a key cylinder axially and rotatably slidably arranged in the diametrical passageway and having opposite ends directed outwardly and inwardly of the housing, and a bolt carried by the key cylinder at its inwardly directed end and adapted to be reciprocally moved by the latter upon manipulation thereof with the aid of a key so as to be selectively protracted across and retracted away from the axial channel and thereby into and out of the apertures of the staple means when the same are received in the axial channel.

In this environment, the improvement comprises a guard for the padlock, and means for supporting the guard in a predetermined relationship to the staple means. Of these:

(a) The guard has the form of a high strength and distortion-resistant substantially cylindrical hollow shell of metal or metal alloy, with the shell having (i) circumferential front and back edges, (ii) an inner diameter slightly greater than the diameter of the peripheral face of the housing of the padlock so as to enable the latter to be axially inserted into and removed from the shell with a nearly sliding fit, (iii) an axial width between its front and back edges somewhat greater than the thickness of the padlock between the front and back faces of the latter, and (iv) a gap in its circumference defined between two axially extending circumferentially spaced edges, the width of the gap being slightly greater than the diameter of the key cylinder of the padlock.

(b) The supporting means, on the other hand, (i) has a member of metal or metal alloy with a flat front surface, (ii) an opening is provided in the member for accommodating the staple means, and (iii) the guard is welded along the circumferential back edge thereof to the member at the front surface of the latter in substantially symmetrically surrounding relation to the opening in the member, with the gap in the shell being located so as to accommodate the key cylinder of the padlock only when the axial passageway in the housing of the padlock is properly aligned with and able to receive the staple means upon insertion of the padlock into the guard.

By virtue of this construction, when the padlock is inserted into the guard and has the staple means received in the axial channel of the padlock and the key cylinder is operated to protract the bolt of the padlock through the aperture in the staple means and to lock the protracted bolt in position, the locking system is rendered resistant to rapid and noise-free destruction of the staple means and the bolt of the padlock.

I claim:

1. A burglar-resistant locking system for closure means of protected premises which locking system utilizes apertured staple means associated with the closure means and a padlock of the type disclosed in U.S. Pat. No. 3,769,821 for cooperating with said staple means, and which padlock includes a substantially cylindrical housing with flat front and back faces and a circular peripheral face, an axial channel extending inwardly from the back face of the housing toward the front face thereof but terminating short of the latter and being dimensioned to accommodate said staple means, a diametrical passageway extending inwardly from one part of the peripheral face of the housing toward but terminating short of the diametrically opposite part of the peripheral face and intersecting the axial channel substantially medially of the housing, a key cylinder axially and rotatably slidably arranged in the diametrical passageway and having opposite ends directed outwardly and inwardly of the housing, and a bolt carried by the key cylinder at its inwardly directed end and adapted to be reciprocally moved by the latter upon manipulation thereof with the aid of a key so as to be selectively protracted across and retracted away from the axial channel and thereby into and out of the apertured staple means when the same are received in the axial channel;

wherein the improvement comprises a guard for the padlock, and means for supporting the guard in a predetermined relationship to said staple means;

(a) said guard having the form of a high strength and distortion-resistant substantially cylindrical hollow shell of metal or metal alloy, said shell having (i) circumferential front and back edges, (ii) an inner diameter slightly greater than the diameter of said peripheral face of the housing of the padlock so as to enable the latter to be axially inserted into and removed from the shell with a nearly sliding fit, (iii) an axial width between its front and back edges somewhat greater than the thickness of the padlock between said front and back faces of the latter, and (iv) a gap in its circumference defined between two axially extending circumferentially spaced edges, the width of said gap being slightly greater than the diameter of the key cylinder of the padlock; and (b) said supporting means having (i) a member of metal or metal alloy with a flat front surface, (ii) an opening in said member for accommodating said staple means, and (iii) said guard welded along said circumferential back edge thereof to said member at said front surface of the latter in substantially symmetrically surrounding relation to said opening in said member and with said gap located so as to accommodate the key cylinder of the padlock only when the axial passageway in the housing of the padlock is properly aligned with and able to receive said staple means upon insertion of the padlock into said guard;

(c) whereby, when the padlock is inserted into said guard and has said staple means received in said axial channel of the padlock and the key cylinder is operated to protract the bolt of the padlock through the apertured staple means and to lock the protracted bolt in position, the locking system is rendered resistant to rapid and noise-free destruction of the staple means and the bolt of the padlock.

2. A locking system as claimed in claim 1, wherein the locking system comprises a hasp including said staple means and said member constituting said supporting means for said guard, said member is a movable plate of the hasp which is mounted at one end thereof on a first component of the closure means through the intermediary of a hinge having a first base plate fixedly secured to said first component, and said apertured staple means of the hasp is mounted on a second component of the closure means through the intermediary of a second base plate fixedly secured to said second component in a position to enable said staple means to be received in and extend through said opening in said member.

3. A locking system as claimed in claim 2, wherein said movable hasp plate over the entire circumference thereof except for the location of the hinge is provided with a flange directed toward said first component of the closure means and is of a width somewhat greater than the thicknesses of said first and second base plates, said movable hasp plate and said flange defining an enclosure for and preventing access to said base plates when the latter are overlaid by, and said staple means is received in said opening of, said movable hasp plate.

4. A locking system as claimed in claim 3, wherein said first and second base plates are reinforced by respective backing plates aligned therewith and located at those surfaces of said first and second components of the closure means which face away from the surfaces thereof at which said base plates are located, and a respective set of fasteners extends through each base plate and its associated backing plate.

5. A locking system as claimed in claim 1, wherein said member constituting said supporting means for said guard is a front side wall of a guide track rail for one edge region of a slidable gate, and said staple means includes (i) a first apertured staple which is fixedly secured to and extends frontwardly from said front side wall directly adjacent said opening in the latter and (ii) a second apertured staple which is adapted to be removably juxtaposed to said first staple so as to locate its aperture in registry with the aperture of said first staple and has a rear portion adapted to be received in and to extend through said opening and through a corresponding opening provided in said one edge region of said slidable gate when the same is moved to its closed position in said guide track rail.

6. A locking system as claimed in claim 5, wherein said guard includes a backplate secured to said shell substantially at said back edge of the latter, said backplate is provided with a slot-shaped opening dimensioned to accommodate both said first and said second staples when the same are in superposed relation to one another, and said guard is secured to said member of said supporting means so as to have one part of said slot-shaped opening receive said first staple and so as to have another part of said slot-shaped opening aligned with said opening in said member for receiving said second staple.

* * * * *